US011285374B2

(12) United States Patent
Hunt et al.

(10) Patent No.: US 11,285,374 B2
(45) Date of Patent: Mar. 29, 2022

(54) BATTING TEE

(71) Applicant: Wilson Hunt International, Ltd., Wheeling, IL (US)

(72) Inventors: Ryan Hunt, Wheeling, IL (US); Matthew Klein, Wheeling, IL (US)

(73) Assignee: Wilson Hunt International, Ltd., Wheeling, IL (US)

( * ) Notice: Subject to any disclaimer, the term of this patent is extended or adjusted under 35 U.S.C. 154(b) by 0 days.

(21) Appl. No.: 16/841,076

(22) Filed: Apr. 6, 2020

(65) Prior Publication Data

US 2020/0316450 A1 Oct. 8, 2020

Related U.S. Application Data

(60) Provisional application No. 62/829,870, filed on Apr. 5, 2019.

(51) Int. Cl.
*A63B 69/00* (2006.01)
*A63B 71/06* (2006.01)

(52) U.S. Cl.
CPC ..... *A63B 71/0622* (2013.01); *A63B 69/0002* (2013.01); *A63B 69/0075* (2013.01); *A63B 69/0091* (2013.01); *A63B 2069/0008* (2013.01); *A63B 2225/093* (2013.01)

(58) Field of Classification Search
CPC ..... A63B 71/0622; A63B 69/0075; A63B 69/0091; A63B 69/0002; A63B 2225/093; A63B 2069/0008; A63B 2071/0694; A63B 2209/14; A63B 2071/0063; A63B 2214/00
USPC ..... 473/417–420, 422, 423, 451, 453
See application file for complete search history.

(56) References Cited

U.S. PATENT DOCUMENTS 3,006,647 A * 10/1961 Haskett ..... A63B 69/0079 473/429
3,940,131 A * 2/1976 St. Claire, Jr. ..... A63B 69/0002 473/417
4,979,741 A * 12/1990 Butcher ..... A63B 69/0002 473/417
5,087,039 A * 2/1992 Laseke ..... A63B 69/0002 473/417
5,685,788 A * 11/1997 Shy ..... A63B 69/0091 473/423
5,897,444 A * 4/1999 Hellyer ..... A63B 69/0075 473/417
5,928,092 A * 7/1999 Keeter ..... A63B 69/0075 473/417
6,413,175 B1 * 7/2002 Mooney, Jr. ..... A63B 69/0075 473/417
8,075,424 B1 * 12/2011 Hostetler ..... A63B 69/0075 473/447

(Continued)

*Primary Examiner* — Nini F Legesse
(74) *Attorney, Agent, or Firm* — Boyle Fredrickson S.C.

(57) ABSTRACT

A batting tee and/or hitting training device is provided that includes a platform, a support extending upwardly from the platform and a holder disposed on the support opposite the platform for holding the ball to be hit. The support additionally includes a cross-beam disposed on the support adjacent the holder. The cross-beam can be positioned at an angle with regard to the support, such that the cross-beam has an upward slope from one end to the other. This slope enables the batting tee to provide the individual with a guide for an upward swing path of the bat towards the ball disposed on the holder.

15 Claims, 2 Drawing Sheets

(56) References Cited

U.S. PATENT DOCUMENTS

| | | | | |
|---|---|---|---|---|
| 8,118,692 | B2 * | 2/2012 | Day | A63B 69/0002 473/453 |
| 8,556,753 | B1 * | 10/2013 | Dixon, Jr. | A63B 69/0075 473/417 |
| 8,597,143 | B2 * | 12/2013 | Newman | A63B 69/0075 473/417 |
| 8,992,348 | B2 * | 3/2015 | Meier | A63B 69/0002 473/417 |
| 9,352,204 | B2 | 5/2016 | Gardner et al. | |
| 9,381,416 | B2 * | 7/2016 | Stojanovic | A63B 69/0075 |
| 9,649,544 | B2 * | 5/2017 | Fitzpatrick | A63B 69/0002 |
| 9,700,777 | B2 | 7/2017 | Dilz, Jr. | |
| D870,219 | S | 12/2019 | Pippitt et al. | |
| D870,220 | S | 12/2019 | Pippitt et al. | |
| 10,583,343 | B2 | 3/2020 | Pippitt et al. | |
| 2005/0266936 | A1 * | 12/2005 | Gutierrez | A63B 69/0002 473/417 |
| 2015/0343289 | A1 | 12/2015 | Gardner et al. | |
| 2018/0169493 | A1 | 6/2018 | Gardner et al. | |

* cited by examiner

BATTING TEE

CROSS-REFERENCE TO RELATED APPLICATIONS

The present application claims priority from U.S. Provisional Patent Application Ser. No. 62/829,870, entitled Batting Tee, and filed on Apr. 5, 2019, the entirety of which is expressly incorporated by reference herein.

FIELD OF THE DISCLOSURE

This disclosure relates to a batting tee or similar device for use in training and individual in sports requiring the participant to hit a ball with an object, such as a bat.

BACKGROUND OF THE DISCLOSURE

In the past a variety of different types of devices have been developed to provide an individual with the opportunity to practice hitting a ball, such as a sports ball, e.g., a baseball, softball or golf ball, among others, that is thrown at and/or struck by the individual. To enable a beginner to develop the necessary muscle memory to hit a moving or stationary ball, the training devices often enable the individual to hit a ball positioned in a stationary position on the training device.

These devices can take many forms and often are constructed with a platform placed on the ground, a support extending upwardly form the platform and a ball holder disposed on the support opposite the platform. The device is utilized by placing the device on a flat surface where the individual can take the necessary stance for hitting a ball, placing the ball on the holder and allowing the individual to swing the bat, club or other implement at the ball located on the holder.

However, while capable of allowing an individual to practice swinging the bat club other item to hit the ball in a stationary position on the device, these prior art devices only enable the individual to swing at the ball without any direction as to the path the swing takes to reach the ball.

Therefore, it is desirable to provide a batting tee/training device that provides additional instruction to the individual using the device regarding the path of the swing taken to hit the ball disposed on the device.

SUMMARY OF THE DISCLOSURE

According to one aspect of an exemplary embodiment of the disclosure, a batting tee and/or hitting training device is provided that includes a platform, a support extending upwardly from the platform and a holder disposed on the support opposite the platform for holding the ball to be hit. The support additionally includes a cross-beam disposed on the support adjacent the holder. The cross-beam is positioned at an angle with regard to the support, such that the cross-beam has an upward slope from one end to the other. This slope enables the batting tee to provide the individual with a guide for an upward swing path of the bat, club or other item towards the ball disposed on the holder.

According to another aspect of an exemplary embodiment of the present invention, the support can be formed to be adjustable in height. This enables the holder and cross-beam to be positioned at the desired height above the ground in order to accommodate persons and/or desired ball positions of varying heights.

Numerous additional aspects, features and advantages of the present disclosure will be made apparent from the following detailed description taken together with the drawing figures.

BRIEF DESCRIPTION OF THE DRAWINGS

The drawings illustrate the best mode of practicing the present disclosure.

In the drawings.

DETAILED DESCRIPTION OF THE DRAWINGS

Figure 1:
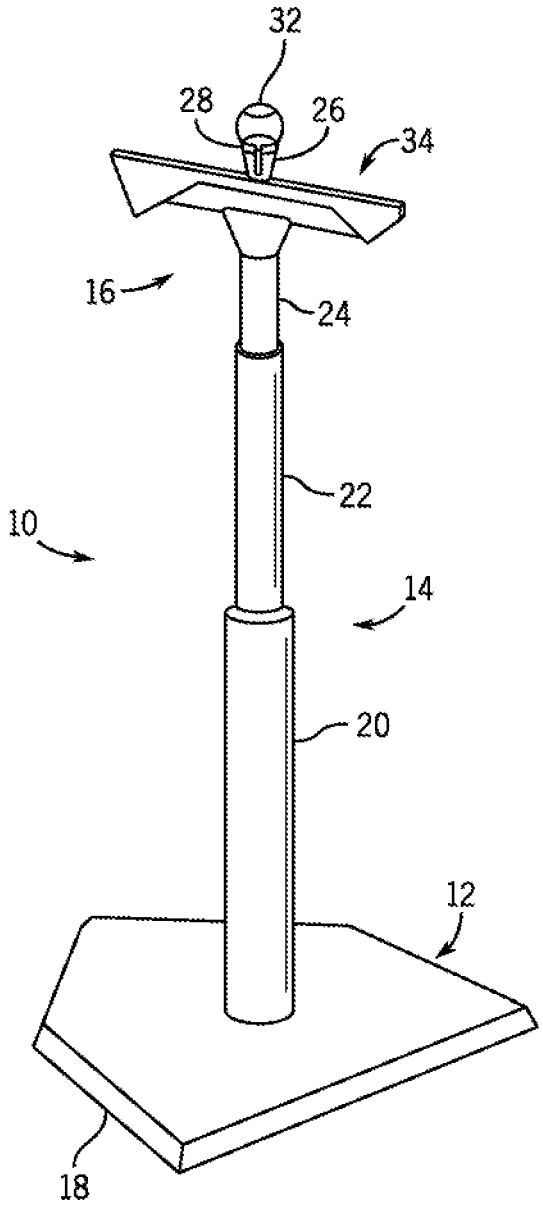
FIG. 1 is an isometric view of a batting tee according to an exemplary embodiment of the disclosure.

With reference now to the drawing figures in which like reference numbers represent like features throughout the application, one exemplary embodiment of a batting tee or device constructed according to the present disclosure is indicated generally at 10 in FIG. 1. The device 10 includes a platform 12 that is adapted to be disposed on a surface, such as the ground, a support 14 extending vertically upwardly from the platform 12 and an adaptor or holder 16 located on the support 14 opposite the platform 12. The members 12-16 are formed of any suitable material and in an exemplary embodiment are formed of a plastic material that provides sufficient flexibility and strength and weight to the device 10.

Figure 2:
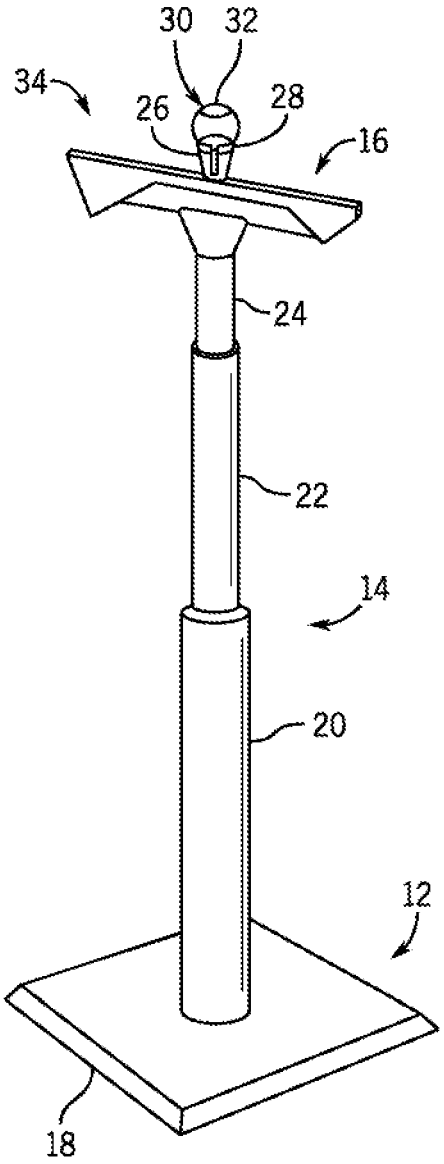
FIG. 2 is an isometric view of a batting tee according to another exemplary embodiment of the disclosure.
Figure 4:
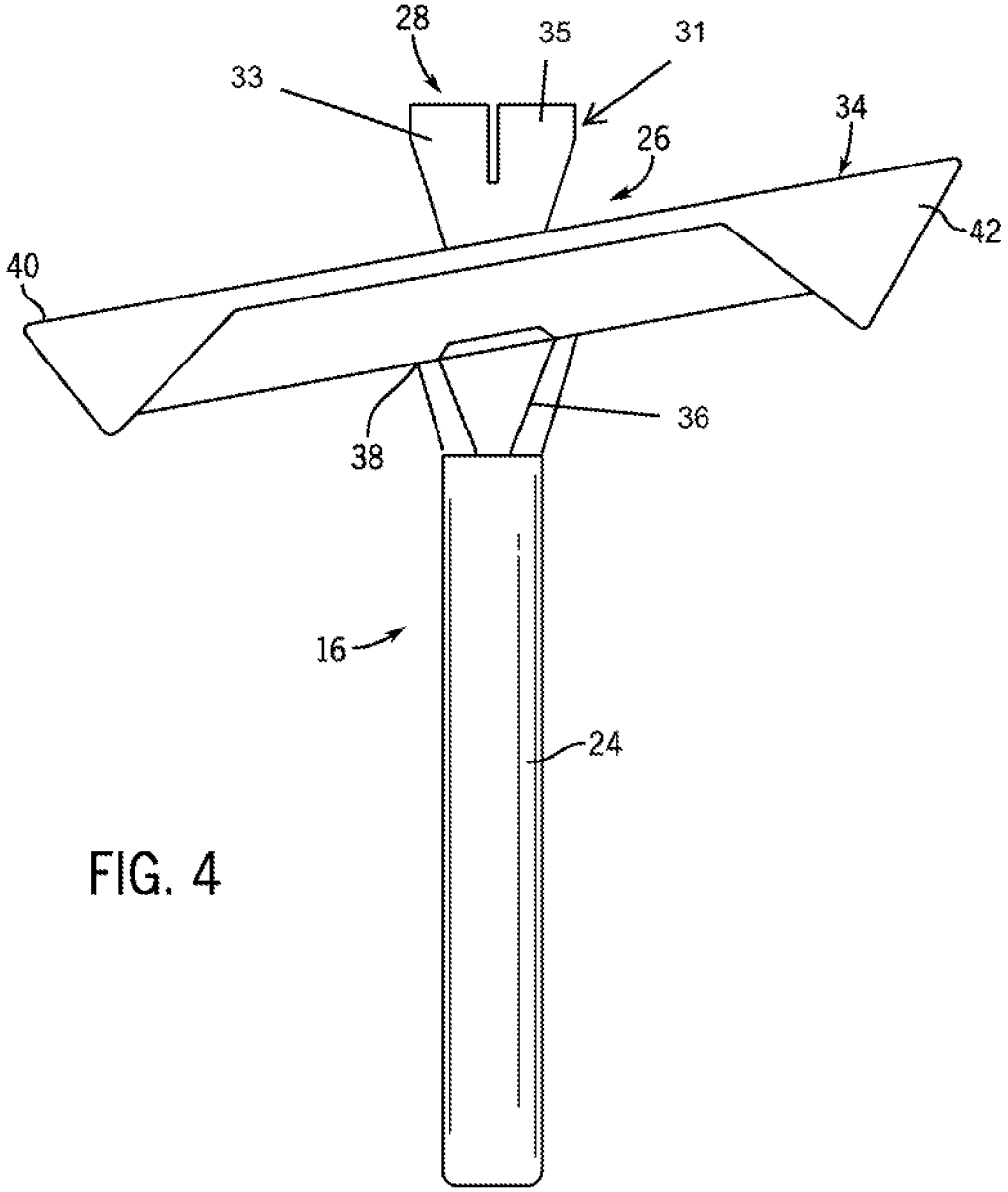
FIG. 4 is a side elevation view of the cross-beam of FIG. 1.

As shown in FIGS. 1 and 2, the platform 12 can be formed of a generally flat member 18 that is shaped to resemble a base, such as a home plate in FIG. 1 and a generic base structure in FIG. 2, or other structure. The platform 12 is shaped to have a sufficient area to provide a stable base for the device 10 when in use, such that the area and/or weight of the platform 12 limits the tipping over of the device 10 when in use, and when struck by the item swung by the individual at the device 10. In addition, the platform 12 can include one or more suitable ground-engaging members (not shown) thereon, such as spikes, teeth, or other structures, that can be formed directly on the platform 12, and more specifically on the lower surface of the platform 12, in order to grip and engage an uneven surface on which the platform 12 is placed, such as a dirt or grass patch on the ground, or other surface. Further, the ground-engaging members can be optionally removable from the platform 12 in order to enable the platform 12 to be positioned on a flat even surface, such as a floor.

The support 14 can be formed as desired, and in the illustrated exemplary embodiment of FIGS. 1 and 2 is formed from a pair of tubular members 20,22 engaged with one another. Tubular member 20 is attached to or integrally formed with the platform 12 at one end and is engaged with the tubular member 22 at the opposed end. Tubular member 22 has a diameter at least slightly less than that of tubular member 20, such that tubular member 22 can be slid telescopically relative to tubular member 20, e.g., into the tubular member 20, to extend the support 14 from a collapsed or storage position (where at least a majority of tubular member 22 is disposed within tubular member 20) to an extended or use position (where at least a majority of tubular member 22 is positioned or extended outside of tubular member 20). In this exemplary embodiment, the tubular member 22 is engaged with the tubular member 20 in a suitable manner, such as by a frictional engagement, that maintains tubular member 22 at the desired position with regard to tubular member 20. Additionally, the tubular member 20 and tubular member 22 can be engaged using a suitable locking mechanism (not shown) that holds the tubular member 22 where desired relative to the tubular member 20, while also allowing the tubular member 22 to freely slide with regard to tubular member 20 when the locking mechanism is disengaged. One example of the locking mechanism would be one or more ridges (not shown) formed on (as partial or completely circumferential ridges) or attached to one of the tubular members 20,22 that are spaced from one another and are engaged within complementary notches (not shown) formed on the other tubular member 20, 22.

Further, each of the tubular members 20, 22 is formed of a sturdy but flexible material, such as a rubber material, that enables the tubular members 20, 22 forming the support 14 to support the holder 16 and one another but that also can flex when inadvertently struck by the item swung by the individual using the device 10 to prevent damage to the device 10 and minimize injury to the user.

Looking now at FIGS. 1-4, the tubular member 22 includes an adaptor or holder 16 engaged with and/or extending upwardly from the tubular member 22 opposite tubular member 20, which in one exemplary embodiment is formed from a material similar to that for the tubular member 20,22. The holder 16 includes a lower portion 24 that has a diameter less than that of the tubular member 22, such that the lower portion 24 is engaged within and movable, e.g., slidable and rotatable, with respect to the tubular member 22. The lower portion 24 can also include a locking mechanism similar to that optionally engaging the tubular member 20,22 with one another.

Opposite the lower portion 24, the holder 16 includes an upper portion 26 including a cup-shaped receptacle 28 opposite the lower portion 24. The cup-shaped receptacle 28 has a depth sufficient to receive and retain a portion of a ball 30 therein, such as a baseball 32, softball (not shown), golf ball (not shown) or other type of sports ball, in order to retain the ball 30 in a stationary position within the receptacle 28. The receptacle 28 also includes a slot 31 formed therein that separates the receptacle 28 into halves 33, 35. The slot 31 allows the halves 33,35 to be compressed towards/against one another when struck by the bat or club swung by the user, which reduces damage from being done to the receptacle 28 when struck.

Figure 3:
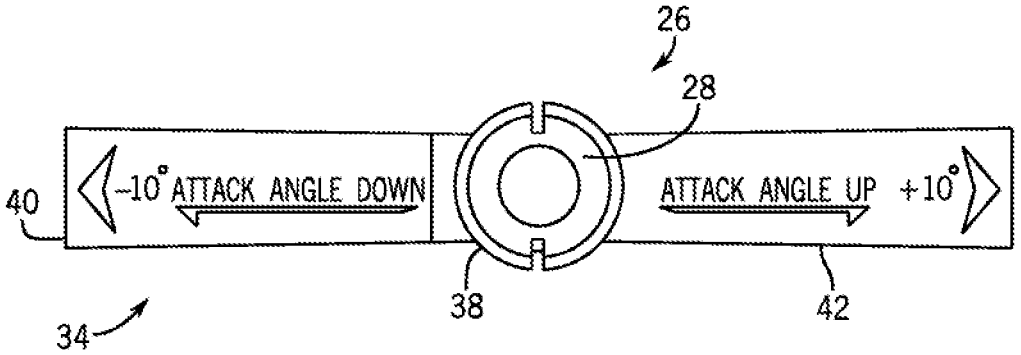
FIG. 3 is a top plan view of the cross-beam of FIG. 1.

On the holder 16 between the lower portion 24 and upper portion 26 is disposed a cross-beam 34. The cross-beam 34 is disposed on a stop 36 formed on the central portion of the holder 16 in order to retain the cross-beam 34 at the desired position on the holder 16. The cross-beam 34 includes a pair of arms 40,42 extending outwardly from opposed sides of the holder 16, which can be perpendicular to the holder 16, but in the illustrated exemplary embodiment of FIGS. 1-3 are angles other than perpendicular to the holder 16. As the cross-beam 34 is formed of a single structure in the illustrated exemplary embodiment, the angles for the opposed halves of the cross-beam 34 are aligned with one another, with one half angled upwardly and the other half angled downwardly with respect to the holder 16. In this manner, the cross-beam 34 can be disposed beneath the receptacle 28 to define a swing path along the angle defined by the cross-beam 34. The position of the cross-beam 34 enables the device 10 to train an individual to swing along the path defined by the cross-beam 34 into the receptacle 28 and ball 30, thereby training an angled swing path. The cross-beam 34 can be formed integrally with the holder 16, such as in a suitable molding process, such that the holder 16 and cross-beam 34 are inserted at the same time into the tubular member 22. Alternatively, the holder 16 and cross-beam 34 can be used as a separate component from the platform 12 and support 14 as a replacement part for ball holders (not shown) in existing batting tees (not shown) to enhance the utility of the existing tees.

In another exemplary embodiment, the cross-beam 34 can be formed separately from the holder 16, such that the angle of the cross-beam 34 can be formed to be movably attached to the holder 16, e.g., by providing a central aperture 38 in the cross-beam 34 through which the holder 16 extends, such that the cross-beam 34 can be varied in orientation relative to the holder 16 as desired to train different swing paths to contact the ball 30. The cross-beam 34 can be pivotally and rotatably moved with regard to the holder 16 such that the cross-beam 34 can be positioned at various horizontal and/or vertical angles with regard to the holder 16.

In still another exemplary embodiment, the cross-beam 34 can be pivotally attached to the holder 16, such that the cross-beam 34 can be moved to different angles relative to the holder 16 to provide steeper or flatter angles for the swing path to the receptacle 28 and ball 30.

In still another exemplary embodiment, the device 10 can be utilized without the support 14, where the holder 16 is directly engaged with the platform 12, such as for use as a golf training device.

In still another exemplary embodiment, the device 10 can be employed without the platform 12, such that the vertical support 14 includes a tubular member 20 or 22 including a tapered lower end (not shown). The tapered end can be driven into the ground in order to engage the tubular member 20, 22 with the ground and to support the holder 16 and ball 30 over the ground in a position to be struck by the user.

Various other alternatives are contemplated is being within the scope of the following claims particularly pointing out and distinctly claiming the subject matter regarded as the invention.

We claim:

1. A ball striking training device comprising:

a) a platform;

b) a holder secured to the platform; and c) a cross-beam secured to the holder above the platform, wherein the cross-beam extends outwardly from opposite sides of the holder at an upward angle relative to one side of the holder and at a downward angle relative to the other side of the holder, and wherein the cross-beam is planar on opposed sides of the holder to define an upward angle swing path.

2. The ball striking training device of claim 1 further comprising a vertical support connected between the platform and the holder.

3. The ball striking training device of claim 2 wherein the holder is movably secured to the vertical support.

4. The ball striking training device of claim 3 wherein the holder is slidably and rotatably secured to the vertical support.

5. The ball striking training device of claim 2 wherein the vertical support comprises:

a) a lower tubular member engaged with the platform; and' b) an upper tubular member engaged with the lower tubular member at one end and with the holder at an opposite end.

6. The ball striking training device of claim 5 wherein the upper tubular member is movably engaged with the lower tubular member.

7. The ball striking training device of claim 6 wherein the upper tubular member is telescopically movable relative to the lower tubular member.

8. The ball striking training device of claim 6 wherein the upper tubular member is rotatably engaged with the lower tubular member.

9. The ball striking training device of claim 5 wherein the holder is slidably and rotatably secured to the vertical support.

10. The ball striking training device of claim 1 wherein the holder includes a receptacle including a slot separating the receptacle into opposed halves.

11. A method for training an angled swing path, the method comprising the steps of:

a) providing the ball striking training device of claim 1;

b) positioning the cross-beam at the desired angle relative to the holder to provide a guide for the desired swing path; and c) swinging at a ball positioned on the holder along the swing path defined by the cross-beam.

12. The method of claim 11 wherein the ball striking training device includes an adjustable height vertical support connected between the platform and the holder, and wherein the method further comprises the step of adjusting the height of the vertical support prior to positioning the cross-beam.

13. The method of claim 11 wherein the step of positioning the cross-beam at the desired angle comprises rotating the cross-beam relative to the holder.

14. A holder for a ball that is adapted to be utilized with a ball striking training device, the holder comprising:

a) a lower portion engagable within a support for a ball striking training device;

b) an upper portion adapted to hold a ball thereon; and c) a cross-beam extending outwardly from opposed sides of the holder between the lower portion and the upper portion at an upward angle relative to one side of the holder and at a downward angle relative to the other side of the holder, and wherein the cross-beam is planar on opposed sides of the holder to define an upward angle swing path.

15. The holder of claim 14 wherein the upper portion includes a receptacle adapted to receive ball therein.

* * * * *